US006444062B2

(12) United States Patent
O'Meara et al.

(10) Patent No.: US 6,444,062 B2
(45) Date of Patent: Sep. 3, 2002

(54) PERFORATED PROPELLANT AND METHOD OF MANUFACTURING SAME

(75) Inventors: William L. O'Meara; Jonathon M. Howard; Antonio F. Gonzalez, all of Tallahassee; John J. Williamson, Crawfordville, all of FL (US)

(73) Assignee: General Dynamics Ordnance & Tactical Systems, Inc., Redmond, WA (US)

( * ) Notice: Subject to any disclaimer, the term of this patent is extended or adjusted under 35 U.S.C. 154(b) by 0 days.

(21) Appl. No.: 09/882,402

(22) Filed: Jun. 16, 2001

Related U.S. Application Data

(62) Division of application No. 09/505,501, filed on Feb. 17, 2000.
(60) Provisional application No. 60/121,208, filed on Feb. 23, 1999.

(51) Int. Cl.[7] ..... D03D 23/00; C06B 21/00
(52) U.S. Cl. ..... 149/109.6; 264/3.3
(58) Field of Search ..... 149/19.8, 97, 109.6; 264/3.3

(56) References Cited

U.S. PATENT DOCUMENTS 2,027,114 A 1/1936 Peake ..... 102/43
2,292,469 A * 8/1942 Olsen (List continued on next page.)

FOREIGN PATENT DOCUMENTS

| | | |
|---|---|---|
| DE | 3242301 A1 | 5/1984 |
| DE | 3913603 C1 | 3/1990 |
| FR | 2 295 932 | 7/1976 |
| FR | 2 621 911 | 4/1989 |
| GB | 2 326 875 A | 1/1999 |

*Primary Examiner*—Michael J. Carone
(74) *Attorney, Agent, or Firm*—Todd E. Garabedian; Wiggin & Dana

(57) ABSTRACT

The present invention is directed to a propellant composition made from a lacquer, the lacquer comprising: (a) from about 15 to about 70 wt % of an organic solvent; (b) from about 0.1 to about 2.5 wt % of a stabilizer; (c) optionally, from about 0% to about 40 wt % of an energetic plasticizer; (d) optionally, from about 0 to about 10 wt % of a nonenergetic plasticizer; (e) optionally, from about 0 to about 10 wt % water; (f) optionally, from about 0 to about 15 wt % of additional additives; and balance being nitrocellulose; all weight percents based on the total weight of the composition, and wherein the lacquer has a viscosity of less than 10 million centipoise when processed. The present invention is also directed to an efficient and safe method of making perforated propellant grains using the above lacquer composition, as well as propellant grains having ellipsoidal cross sections or outwardly extending ridges.

7 Claims, 1 Drawing Sheet

U.S. PATENT DOCUMENTS 3,163,567 A 12/1964 Silk ..... 149/2
3,201,500 A * 8/1965 Ryker
3,223,756 A 12/1965 Goodyear et al. ..... 264/3
3,392,669 A * 7/1968 Picard
3,679,782 A 7/1972 Andrew et al. ..... 264/3
3,855,373 A * 12/1974 Swotinsky et al.
3,989,776 A * 11/1976 Dunigan et al.
4,001,287 A * 1/1977 Dunigan et al.
4,014,719 A 3/1977 Wells ..... 149/92
4,018,637 A 4/1977 Kimmel et al. ..... 149/96
4,051,207 A * 9/1977 Brachert et al.
4,172,866 A * 10/1979 Graham
4,243,442 A 1/1981 Armantrout ..... 149/19.92
4,408,534 A 10/1983 Araki et al. ..... 102/288
4,420,350 A 12/1983 Camp et al. ..... 149/92
4,462,848 A * 7/1984 Elrick
4,477,297 A 10/1984 Chi ..... 149/19.92
4,521,261 A 6/1985 Davies ..... 149/92
4,659,402 A 4/1987 Comfort ..... 149/19.4
4,694,753 A 9/1987 Thomas ..... 102/289
4,701,228 A 10/1987 Lagreze et al. ..... 149/109.6
4,841,863 A 6/1989 Bourgeois ..... 102/523
4,842,658 A 6/1989 Boileau et al. ..... 149/92
4,909,868 A 3/1990 Melvin ..... 149/109.6
4,950,342 A 8/1990 Canterberry ..... 149/109.6
5,125,684 A 6/1992 Cartwright ..... 149/92
5,218,166 A 6/1993 Schumancher ..... 149/19.92
5,266,242 A 11/1993 Mogendorf et al. ..... 149/19.92
5,468,311 A 11/1995 Godsey et al. ..... 149/19.4
5,507,891 A * 4/1996 Zeigler
5,510,062 A 4/1996 O'Meara et al. ..... 264/3.4
5,524,544 A 6/1996 O'Meara et al. ..... 102/287
5,540,794 A 7/1996 Willer et al. ..... 149/19.8
5,821,449 A 10/1998 Langsjoen ..... 102/288

* cited by examiner

PERFORATED PROPELLANT AND METHOD OF MANUFACTURING SAME

This Patent Application is a divisional of U.S. patent application Ser. No. 09/505,501 that was filed on Feb. 17, 2000 which claims priority to U.S. Provisional Pat. App. Ser. No. 60/121,208 filed on Feb. 23, 1999. The disclosure of U.S. patent application No. 09/505,501 and Provisional Pat. App. Ser. No. 60/121,208 are incorporated herein by reference in their entireties.

BACKGROUND OF THE INVENTION

1. Field of the Invention

This invention relates to a propellant composition made from a lacquer and processed to form hollow propellant grains that are useful for ammunition rounds. More particularly, the invention is directed to a low viscosity lacquer that is continuously processed by extrusion to form hollow hardened propellant grains in a liquid slurry.

2. Description of Related Art

Perforated propellant grains are generally produced by extruding lacquers having between 0 and 20% by weight of solvent. This method of production requires a pressure in the range of between about 1000 and 5000 psi to extrude the lacquer through an extrusion die assembly, and requires large quantities of energy and expensive equipment. The following U.S. Patents are representative of the state of the art.

U.S. Pat. No. 5,821,449 entitled, "Propellant grain geometry for controlling ullage and increasing flame permeability" that issued on Oct. 13, 1998 discloses hollow grain propellants for use in lightweight training rounds.

U.S. Pat. No. 4,841,863 entitled, "Saboted, light armour penetrator round with improved powder mix" that issued on Jun. 27, 1989 discloses propellant in the form of spheroidal (substantially spherical) powders and recites that a batch process for the manufacture of spherical powders is disclosed in U.S. Pat. No. 2,027,114 and a continuous process in U.S. Pat. No. 3,679,782.

U.S. Pat. No. 5,524,544 entitled, "Nitrocellulose propellant containing a cellulosic burn rate modifier" that issued on Jun. 11, 1996 and U.S. Pat. No. 5,510,062 entitled, "Method of producing a nitrocellulose propellant containing a cellulosic burn rate modifier infiltrated therein that issued on Apr. 23, 1996 disclose a solvent process for the manufacture of propellant grains where a burn rate deterrent is gradationally dispersed within the propellant with the greatest concentration of deterrent at the particulate periphery.

U.S. Pat. Nos. 2,027,114; 3,679,782; 4,841,863; 5,510,062; 5,524,544 and 5,821,449 are all incorporated by reference in their entireties herein.

Accordingly, what is needed in the art is a lacquer composition and method of manufacturing that efficiently produces perforated propellant grains in a safe and economical manner, and at a lower extrusion pressure than presently used. The present invention is believed to be an answer to that need.

SUMMARY OF THE INVENTION

In one aspect, the present invention is directed to a propellant composition made from a lacquer, the lacquer comprising: (a) from about 15 to about 70 wt % of an organic solvent; (b) from about 0.1 to about 2.5 wt % of a stabilizer; (c) optionally, from about 0% to about 40 wt % of an energetic plasticizer; (d) optionally, from about 0 to about 10 wt % of a nonenergetic plasticizer; (e) optionally, from about 0 to about 10 wt % water; (f) optionally, from about 0 to about 15 wt % of additional additives; and balance being nitrocellulose; all weight percents based on the total weight of the composition, and wherein the lacquer has a viscosity of less than 10 million centipoise when processed.

In another aspect, the present invention is directed to a propellant composition made from a lacquer, the lacquer consisting essentially of: (a) from about 30 to about 65 wt % of an organic solvent selected from the group consisting of ethyl acetate, ether, acetone, and combinations thereof; (b) from about 0.25 to about 1.5 wt % of a stabilizer selected from the group consisting of diphenylamine, ethyl centralite, diethyldiphenylurea, 2-nitrodiphenylamine, N-nitrosodiphenylamine, and combinations thereof; (c) optionally, from about 5% to about 25 wt % of nitroglycerin as an energetic plasticizer; (d) optionally, from about 0 to about 3 wt % of a nonenergetic plasticizer selected from the group consisting of dibutylphthlate, adipate esters, and combinations thereof; (e) optionally, from about from about 0 to about 4 wt % water; (f) optionally, from about 0 to about 15 wt % of additional additives selected from the group consisting of lubricants; coolants; barrel wear additives; flash suppressants; decoppering agents; energetic solids, and combinations thereof; and balance being nitrocellulose; wherein all weight percents are based on the total weight of the composition, and wherein the lacquer has a viscosity of between 1 million and 3 million centipoise.

In another aspect, the present invention is directed to a method for manufacturing perforated propellant grains, comprising the steps of: extruding a propellant lacquer through an extrusion die assembly to form one or more propellant lacquer strands, the extrusion die assembly having a plurality of holes, each of the holes having at least one pin tip positioned therein, the propellant lacquer comprising: (a) from about 15 to about 70 wt % of an organic solvent; (b) from about 0.1 to about 2.5 wt % of a stabilizer; (c) optionally, from about 0% to about 40 wt % of an energetic plasticizer; (d) optionally, from about 0 to about 10 wt % of a nonenergetic plasticizer; (e) optionally, from about 0 to about 10 wt % water; (f) optionally, from about 0 to about 15 wt % of additional additives; and balance being nitrocellulose; all weight percents based on the total weight of the composition, and wherein the lacquer has an extrusion viscosity of less than 10 million centipoise; cutting the propellant lacquer strand to a desired dimension to form perforated propellant grains; suspending the perforated propellant grains in a water based liquor; removing the organic solvent and water from the perforated propellant grains; and hardening the perforated propellant grains.

In another aspect, the present invention is directed to a propellant grain having outwardly extending ridges.

In another aspect, the present invention is directed to a propellant grain having an ellipsoidal cross section.

These and other aspects will be more fully understood from the following detailed description of the invention.

DESCRIPTION OF THE DRAWINGS

The invention will be more fully understood from the following detailed description taken in conjunction with the accompanying drawings in which.

DETAILED DESCRIPTION OF THE INVENTION

Figure 1A:
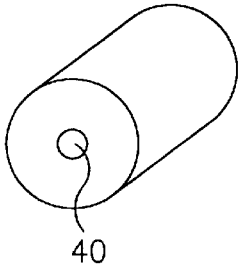
FIG. 1A shows a hollow, tubular portion of the propellant grains of the invention having a single internal perforation.

It has now been found that perforated propellant grains may be manufactured continuously from a specific lacquer composition in a safe, cost-effective, and efficient manner. The continuous preparation of a perforated propellant produces a strand having a generally cylindrical shape with one or more inner concentric hollow cylinders (termed perforations) arranged parallel to the longitudinal axis of the strand. The produced strands may be cut to desired sizes, may be flattened to form ellipsoid shapes, or may be formed to specific configurations (e.g., with outwardly extending ridges). The cut strands (grains) are made from a composition that requires less pressure to extrude during the manufacturing process, thereby considerably reducing energy and equipment costs.

As defined herein, the term "perforation" refers to a tubular space (hollow cylinder) oriented parallel to the longitudinal axis of the strand or grain.

As indicated above, the propellant of the present invention is made from a lacquer comprising (a) an organic solvent; (b) a stabilizer; (c) optionally, an energetic plasticizer; (d) optionally, a nonenergetic plasticizer; (e) optionally, water; and (f) optionally, additional additives; and the balance being nitrocellulose. Each of these components is discussed in detail below.

Solvents that are useful in the composition and method of the present invention include ethyl acetate, ether, acetone, and combinations thereof. A preferred solvent is ethyl acetate. Preferably, the amount of solvent used in the composition of the invention ranges from about 15 to about 70 wt %, and more preferably from about 30 to about 65 wt %, based on the total weight of the composition.

The lacquer composition of the invention also includes one or more stabilizers. Examples of suitable stabilizers include diphenylamine, ethyl centralite, diethyldiphenylurea, 2-nitrodiphenylamine, N-nitrosodiphenylamine, and combinations thereof. Useful amounts of the stabilizers in the composition of the present invention generally range from 0.1 wt % to about 2.5 wt %, and more preferably from about 0.25 wt % to about 1.5 wt %, based on the total weight of the composition.

The balance of the lacquer composition of the invention is nitrocellulose. The nitrocellulose used in the present invention may be in any form. However, in a preferred embodiment, the nitrocellulose is completely dissolved in one or more solvents.

Optionally, the lacquer composition of the invention includes an energetic plasticizer such as nitroglycerin, ethylene glycol esters, methylene glycols, glycol esters, formyl acetal (bis(2,2-dinitropropyl)formal acetal) and combinations thereof. If such an energetic plasticizer is included in the composition, a useful working range is from about 0% to about 40 wt %, and more preferably from about 5 to about 25 wt %, based on the total weight of the composition.

Optionally, the lacquer composition of the invention also includes a nonenergetic plasticizer such as dibutylphthalate, adipate esters, and combinations thereof. A preferred nonenergetic plasticizer is DBP (dibutylphthalate). Generally, the nonenergetic plasticizer component comprises from about 0 to about 10 wt %, and more preferably from about 0 to about 3 wt %, based on the total weight of the composition.

The lacquer composition of the invention may also include optional additives, including lubricants, such as graphite; coolants, such as magnesium carbonate; barrel wear additives, such as tin dioxide, titanium dioxide, calcium bicarbonate, and the like; flash suppressants, such as potassium salts; decoppering agents, such as bismuth and tin dioxides; and energetic solids known in the art, such as RDX, HMX, CL20, nitroguanidine, and the like.

Other additives may be present in amounts effective for desired results. Such additives such as deterrents may influence burn rate, burn temperature, extrusion performance or other properties of manufacture or use.

The lacquer composition of the present invention is prepared by mixing the above ingredients in an agitated kettle until a homogeneous lacquer is produced.

An aqueous process for the manufacture of perforated propellant begins with the formation of a propellant lacquer as described above. The extrusion viscosity of the lacquer should be less than 10 million centipoise, and is preferably between 1 million and 3 million centipoise. At this viscosity, the lacquer of the invention may be pumped through a perforated extrusion die assembly as described below at a pressure of between 30 and 200 pounds per square inch. This method is to be contrasted with conventionally extruded lacquers having between 0 and 15% by weight of solvent that require a pressure in the range of between about 1000 and 5000 psi to extrude.

One suitable lacquer has the composition, by weight, of:

| Component | Weight % |
|---|---|
| Organic solvent | 15%–70% |
| Energetic Plasticizer | 0–40% |
| Stabilizer | 0.1%–2.5% |
| Nonenergetic Plasticizer | 0–10% |
| Water | 0–10% |
| Nitrocellulose | balance |

In a preferred embodiment, the lacquer has the composition, by weight, of:

| Component | Weight % |
|---|---|
| Ethyl Acetate | 30%–65% |
| Nitroglycerin | 5%–25% |
| Stabilizer | 0.25%–1.5% |
| Dibutylphthlate | 0–3% |
| Water | 1%–4% |
| Nitrocellulose | balance |

Without wishing to be bound by any particular theory, it is believed that the lacquers formed from these components function as a Newtonian shear thinning fluid. The lacquer made according to the method of the invention has a low viscosity and is easily pumped through the extrusion die assembly and thereby requiring less energy and equipment costs.

In order to produce the perforated propellant, the lacquer is pumped through an extrusion die assembly and into an aqueous solution, referred to as liquor. The extrusion die assembly has a plurality of die holes, each of which has at least one pin tip positioned therein to produce grains having hollow cores (perforations). The liquor is preferably water-based, and generally maintained at a temperature of between about 35 and 80° C. Up to about 6% by weight of a salt (a dewatering agent) and up to about 6% by weight of a surfactant (an antiagglomerating agent) may be added to the liquor. A suitable salt is sodium sulfate, and a suitable surfactant is a colloid. Rotating knives adjacent to the base surface of the plate cut the lacquer strand into perforated cylinders of lengths which are controlled by the rate of revolution of the rotating knives and/or by controlling the pump speed. Generally, the cut perforated propellant grains have a length-to-diameter ratio of approximately 2:1. The liquor is then used to safely transport the perforated propellant through both the dewatering and solvent removal and grain hardening stages.

To control dewatering, temperature, time, residual solvent and salt concentration in the liquor are controlled. Typically dewatering involves heating the liquor to a temperature of between about 35° C. and 80° C., and preferably of between 40° C. and 60° C.

After dewatering, and/or while dewatering, the perforated grains then go through a solvent removal process. This process can begin with the addition of solventless liquor to the system. This step dilutes the solvent in the liquor and results in solvent removal (leaching) from the perforated grains at a controllable rate. This method of solvent removal can be used to remove enough solvent such that the perforated grains become tough and leathery, however in some cases it may be desirable to leave up to about 40% solvent by weight in the grained material. At this stage, the perforated grains can be heated without softening to the point of deformation.

To harden the grains, the temperature of the perforated grains and liquor is increased and/or vacuum is applied until the solvent is removed to a level sufficient enough for storage. Heating may be up to any temperature up to or less than the boiling point of water, and is generally dependent on whether a vacuum is employed. At atmospheric pressure, a temperature of up to about 99° C. may be utilized. At 11.5 inches of pressure, the maximum temperature is about 86° C.

The perforated grains can be further impregnated or coated, such as with nitroglycerin (an energetic plasticizer) or with a deterrent, and dried for use to form the finished propellant.

Figure 1B:
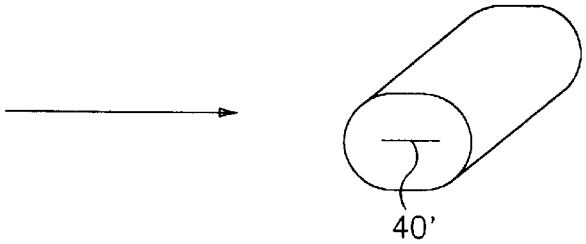
FIG. 1B shows the hollow, tubular portion of FIG. 1A in a flattened state.

Changing the shape of the die hole of the extrusion die assembly changes the outer surface configuration of the grains and influences burn rate and performance. Exemplary shapes for propellant grains are illustrated in FIGS. 1A, 1B, 2A, 2B, and 3. FIG. 1A shows a grain having a circular cross section and a perforation 40 centered in the strand cross section and running parallel to the longitudinal axis of the strand. The grain shown in FIG. 1A can be compressed to form a grain having an ellipsoidal cross section as shown in FIG. 1B. The flattened propellant grain with ellipsoidal cross section of FIG. 1B, provides for increased packing density for increased propellant weight capability when compared to the grain with a circular cross section of FIG. 1A. The FIG. 1B shape also has utility to decrease temperature sensitivity (the tendency of a propellant to burn quicker at higher temperatures and slower at lower temperatures).

Figure 2A:
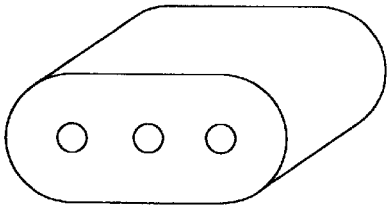
FIG. 2A shows an alternative embodiment of the propellant grains of the invention having a plurality of internal perforations.
Figure 2B:
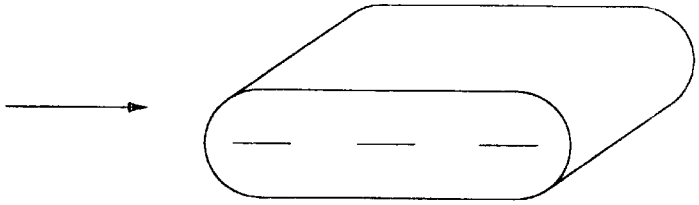
FIG. 2B shows the alternative embodiment of FIG. 2A in a flattened state.

FIGS. 2A and 2B show the addition of multiple perforations to influence burn characteristics of the grains. In this embodiment, the extrusion die assembly would have a plurality of pin tips to form the desired number of perforations through the strand. The configuration of FIG. 2B having an ellipsoidal cross section is made in a similar manner to the grain shown in FIG. 1B.

Figure 3:
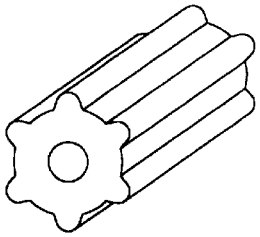
FIG. 3 shows another alternative embodiment of the propellant grains of the invention having outwardly extending ridges.

FIG. 3 illustrates a ridged, perforated, propellant grain with a geometry that provides for a low packing density for a lower propellant charge weight and also fills a cartridge volume, reducing ullage. The ridged propellant grains are characterized by superior ignition and flame permeability when compared to similarly configured perforated propellants without the ridges. The reduction in ullage provides enhanced safety and ballistic uniformity.

While the invention has been described in combination with embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims. All patent applications, patents, and other publications cited herein are incorporated by reference in their entireties.

What is claimed is:

1. A method for manufacturing perforated propellant grains, comprising the steps of:

extruding a propellant lacquer through an extrusion die assembly to form one or more propellant lacquer strands, said extrusion die assembly having a plurality of holes, each of said holes having at least one pin tip positioned therein, said propellant lacquer comprising:

(a) from about 15 to about 70 wt % of an organic solvent;

(b) from about 0.1 to about 2.5 wt % of a stabilizer;

(c) optionally, from about 0 % to about 40 wt % of an energetic plasticizer;

(d) optionally, from about 0 to about 10 wt % of a nonenergetic plasticizer;

(e) optionally, from about 0 to about 10 wt % water;

(f) optionally, from about 0 to about 15 wt % of additional additives;

balance being nitrocellulose; all weight percents based on the total weight of said composition, and wherein said lacquer has an extrusion viscosity of less than 10 million centipoise;

cutting said propellant lacquer strand to a desired dimension to form perforated propellant grains;

suspending said perforated propellant grains in a water based liquor;

removing said organic solvent and water from said perforated propellant grains; and hardening said perforated propellant grains.

2. The method of claim 1, wherein said perforated propellant grains have a circular cross-section.

3. The method of claim 1, wherein said organic solvent is selected from the group consisting of ethyl acetate, ether, acetone, and combinations thereof.

4. The method of claim 1, wherein said stabilizer is selected from the group consisting of diphenylamine, ethyl centralite, diethyldiphenylurea, 2-nitrodiphenylamine, N-nitrosodiphenylamine, and combinations thereof.

5. The method of claim 1, wherein said optional energetic plasticizer is selected from the group consisting of nitroglycerin, ethylene glycol esters, methylene glycols, glycol esters, bis (2,2-dinitropropyl) formal acetal, and combinations thereof.

6. The method of claim 1, wherein said optional nonenergetic plasticizer is selected from the group consisting of dibutylphthalate, adipate esters, and combinations thereof.

7. The method of claim 1, wherein said optional additional additives are selected from the group consisting of lubricants; coolants; barrel wear additives; flash suppressants; decoppering agents; energetic solids, and combinations thereof.

* * * * *